United States Patent [19]

Reiling

[11] 4,361,782

[45] Nov. 30, 1982

[54] JACKETED DISCHARGE LAMP HAVING OXIDIZABLE FAIL-SAFE SWITCH

[75] Inventor: Gilbert H. Reiling, Chardon, Ohio

[73] Assignee: General Electric Company, Schenectady, N.Y.

[21] Appl. No.: 163,108

[22] Filed: Jun. 26, 1980

[51] Int. Cl.[3] ..... H01J 7/44; H01J 17/34; H01J 19/78; H01J 29/96

[52] U.S. Cl. ..... 315/73; 315/74; 313/25

[58] Field of Search ..... 315/73, 74, 46, 47, 315/49, 56; 313/25

[56] References Cited

U.S. PATENT DOCUMENTS

| | | | |
|---|---|---|---|
| 4,013,919 | 3/1977 | Corbley | 315/73 |
| 4,090,105 | 5/1978 | Koo | 315/74 |
| 4,195,251 | 3/1980 | Bamberg | 315/73 |
| 4,205,258 | 5/1980 | Ward | 315/73 |
| 4,208,614 | 6/1980 | Strauss et al. | 315/73 |
| 4,233,542 | 11/1980 | Oostvogels et al. | 315/73 |

*Primary Examiner*—Saxfield Chatmon, Jr.

*Attorney, Agent, or Firm*—Ernest W. Legree; Philip L. Schlamp; Fred Jacob

[57] ABSTRACT

A jacketed discharge lamp which would release ultraviolet radiation in the event of fracture of the outer envelope is provided with a disabling fuse link which oxidizes in the event of breakage. The link consists of an alkaline earth metal film, suitably a barium film which may be deposited on a ceramic substrate for connection into the circuit. The outer envelope is evacuated or may contain an inert gas.

5 Claims, 3 Drawing Figures

JACKETED DISCHARGE LAMP HAVING OXIDIZABLE FAIL-SAFE SWITCH

The invention relates to jacketed discharge lamps of the kind wherein the inner arc tube transmits ultraviolet radiation which is normally absorbed without harm by the glass outer envelope or jacket but which could be hazardous in the event of breakage of the jacket.

BACKGROUND OF THE INVENTION

In the field of high intensity (HID) lamps, the high pressure mercury and the metal halide families generally utilize a quartz or fused silica arc tube enclosed within a glass outer jacket fitted with a screw base at one end. In the mercury lamp the arc tube contains a filling of mercury whereas in the metal halide lamp the filling comprises mercury and metal halides. In both kinds, the inner arc tube transmits ultraviolet radiation which is absorbed without harm by the glass outer envelope, or even absorbed gainfully by a phosphor coating on the outer envelope.

In most lamps the outer envelope remains intact to the end, and life is ended by other factors. However, its does happen occasionally that the outer envelope or jacket is punctured or shattered while the arc tube remains intact and the lamp continues to operate. In this mode of operation, ultraviolet radiation from the arc tube may escape and create a safety hazard. The Bureau of Radiological Health of the Food and Drug Administration (Dept. of HEW) has requested lamp manufacturers to develop self-extinguishing lamps, that is lamps with built-in safeguards that will permanently extinguish the arc discharge in the event of jacket failure.

One type of self-extinguishing lamp achieves self-extinction by means of a mechanical switch connected in series with the arc tube and maintained closed by pressure from contact with the jacket. While such a switch is relatively inexpensive, instantaneous in its action and wastes no power, it may not be activated if the jacket is merely punctured and not completely broken away. Published FDA Regulations (Fed. Reg. Vol. 44, No. 175, p 52191-6) coming into force in September 1981, require that a self-extinguishing lamp cease operation within a cumulative operating time not exceeding 15 minutes following removal of at least 3 square centimeters of contiguous surface of the outer envelope. The mechanical switch safety lamp will not meet this specification.

To comply with the new F.D.A. requirement, it is necessary to go to designs utilizing an oxidizable fuse connected in series with the arc tube and located within the outer envelope. It has been proposed to use a tungsten or a molybdenum filament which should have a low resistance in order to minimize power dissipation and also assure a filament life matching that of the relatively long-lived arc tube. However, a low resistance filament may require an excessively long time to oxidize and open the circuit after outer envelope breakage. In U.S. Pat. No. 4,013,919 - Discharge Lamp Having Fuse Switch Guard Against Jacket Failure, a filament serving as a fuse is provided in series with the arc tube and a thermal switch shunts the filament. This permits a filament of higher resistance to be used, and wastage of energy is prevented because heat from the arc tube causes the thermal switch to close and short-circuit the filament under normal operating conditions. While a filament fuse shorted by a thermal switch can satisfy the FDA specification, it is a complicated and relatively costly solution.

SUMMARY OF THE INVENTION

The object of the invention is to provide a self-extinguishing HID safety lamp complying with the new FDA specification and which is inexpensive and easy to manufacture. Preferably the lamp should be as efficient as non-complying lamps, meaning that the self-extinguishing feature should not waste power during normal operation and should operate reliably irrespective of the burning position of the lamp. A self-extinguishing feature which can be used in a family of mercury and metal halide lamps of different wattages and sizes is desired.

In accordance with my invention, I provide in series with the arc tube an oxidizable fuse link consisting of an alkaline earth metal film, suitably a barium film, which may be located within the outer jacket. When the jacket is punctured or broken, atmospheric oxygen enters the normally inert environment whereupon the metal film oxidizes and interrupts the circuit. Even when the hole in the outer envelope is no larger than the minimum specified by the FDA specification, the interruption of the circuit occurs promptly after the jacket is punctured. The metal film may be supported and connected into the lamp circuit in various ways. In one simple arrangement, a barium film is deposited on a ceramic substrate between sets of contacts which are connected into the circuit.

DESCRIPTION OF PREFERRED EMBODIMENT

Figure 1:
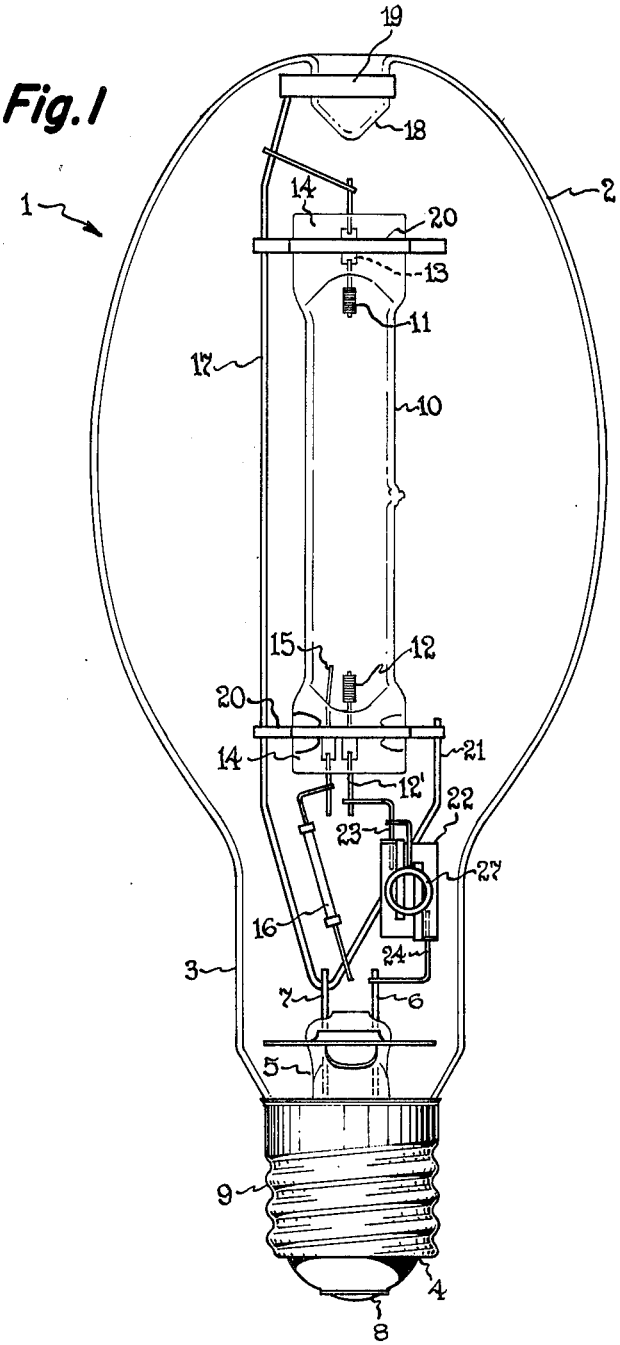
FIG. 1 shows a high pressure metal vapor lamp embodying the invention.

Referring to the drawing and more particularly to FIG. 1, there is shown an HID lamp embodying the invention in the form of a high pressure mercury vapor lamp 1. It comprises a glass outer envelope or jacket 2 of ellipsoidal shape having a neck 3 to the end of which is attached a screw base 4. The neck 3 is closed by a re-entrant stem 5 having a press portion through which extend relatively stiff inlead wires 6, 7. The inlead wires are connected exteriorly to the contact surfaces of the base, namely the insulated center contact or eyelet 8 and the base shell 9.

Inner arc tube 10 is made of fused silica, commonly referred to as quartz, and encloses a charge of mercury and an inert starting gas, suitably argon at a pressure of about 20 torr. In a metal halide lamp, the filling would include additionally small quantities of one or more metallic halides, for instance sodium and scandium iodides. The arc tube is provided at opposite ends with a pair of main discharge supporting electrodes 11,12 to which connections are made by inleads which include thin foil portions 13 sealed through the flattened or pressed ends 14 of the tube. A fine tungsten wire 15 sealed into the arc tube at its lower end serves as an auxiliary starting electrode and is connected through a current limiting resistor 16 to inlead 7 by way of side rod 17. The side rod is welded to inlead 7 at the base end and extends to anchoring dimple 18 at the dome end of the envelope which it engages by a looped clip 19. The arc tube is attached to the mount frame by clamping its flat ends 14 between strap clips 20 which are welded to side rod 17, the lower clip being additionally welded to reverted portion 21 of the side rod.

The arc discharge through mercury vapor at a pressure exceeding 1 atmosphere generates both visible and ultraviolet radiation which pass readily through the fused silica wall of the arc tube 10. However the glass wall of the outer envelope 2 is opaque to the ultraviolet radiation which is harmlessly absorbed. In deluxe mercury lamps, the outer envelope is coated internally with a phosphor layer (not shown) which converts some of the shorter wavelength radiation produced by the discharge into visible light including red whereby the color rendition from the lamp is greatly improved. There is no oxygen in the space within outer envelope 2; it may be either evacuated or filled with an inactive gas such as argon.

It is possible for the jacket to be punctured, for instance by a projectile from an air rifle, and the arc tube to remain intact. Or again when a lamp as illustrated is operated base up, the jacket could shatter and fall off upon being struck by a ball or other projectile and the arc tube and connections thereto remain intact. The lamp may continue to operate in this fashion for a considerable time during which ultraviolet radiation from the arc tube may escape and create a safety hazard.

Figure 2:
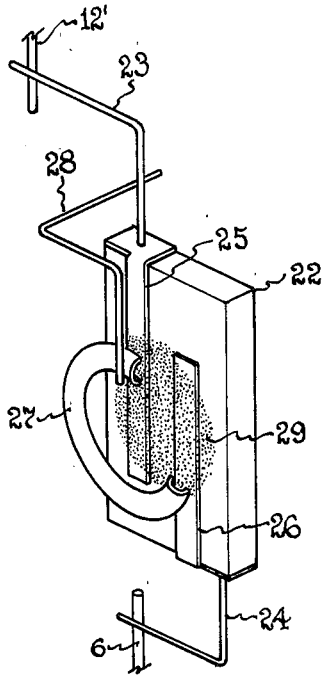
FIG. 2 is a pictorial detail to a greater scale of the barium film fuse link.

In accordance with my invention, the foregoing hazardous possibilities are eliminated by providing an oxidizable link incorporating a thin oxidizable metallic film in one of the connections within the outer envelope which go from the inleads 6 or 7 to the main electrodes 11 or 12. The alkaline earth metals beryllium, magnesium, calcium, strontium and barium form such films. Radium of the same Group II A should be avoided because it is radioactive. Also beryllium is generally considered hazardous because of its easy absorption by the human body. The preferred film material is barium on account of its low cost and ready availability. As best seen in FIG. 2, the oxidizable link comprises a ceramic wafer 22 having metal leads 23, 24 embedded in it from opposite edges. Lead 23 is spot-welded to electrode inlead 12' and lead 24 to inlead 6. Spaced and parallel extending metal contact strips 25, 26 are fixed to the surface of the wafer and connected to leads 23, 24, respectively. A barium getter ring 27 consisting of a channeled or slightly dished metal ring containing vaporizable barium powder is supported by means of a wire 28 attached to lead 23. It is arranged so that the channeled side in which the powder is laid faces the contact strips 25, 26.

As part of the lamp manufacturing process, the arc tube and mount frame assembly comprising arc tube 10 supported on glass stem 5 is inserted into the outer envelope 2 and the stem sealed to the neck of the envelope. At this stage, the outer envelope is exhausted of air and the barium getter ring 27 is flashed in vacuum. Flashing may be accomplished by inductively coupling high frequency current into the ring to bring it up to a temperature sufficient to vaporize the barium. The barium deposits as a very thin silvery film 29 indicated in FIG. 2 which conductively bridges the contact strips 25,26. The outer jacket may then be tipped off under vacuum or, in the case of some HID lamps, after having first been back-filled with an inert gas such as argon. Other inert gases, for instance krypton, could be used but since argon is by far the cheapest, no other is used. Nitrogen must not be used because it reacts with barium to form non-conductive barium nitride.

In operation of the lamp, so long as the outer jacket remains intact the fuse link remains passive and the barium film serves as a low resistance conductive bridge between the contact strips 25, 26. The desirability of a low resistance provides a measure of the minimum thickness which the film should have. In the event of puncture or fracture of the outer jacket, air upon entering will start to react with the barium film causing it to oxidize and its resistance to increase. The film heats up more and the oxidation process intensifies until the film becomes fully oxidized and non-conducting, whereupon the arc tube is permanently extinguished.

Figure 3:
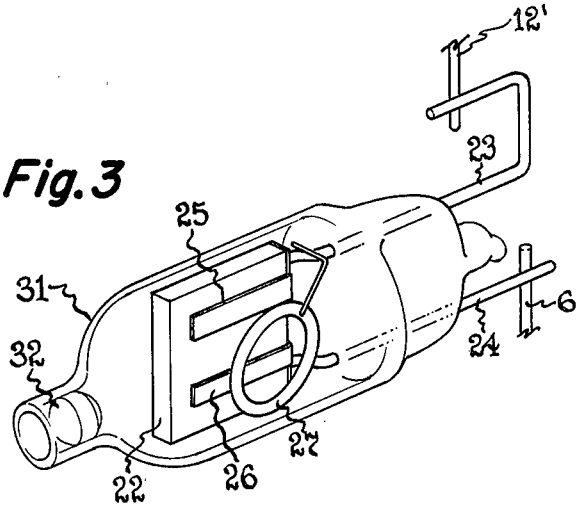
FIG. 3 is a pictorial view of an alternative arrangement in which the barium film is contained in an auxiliary envelope.

In order to form the conductive barium film 29, the getter ring 27 must be flashed in a vacuum. With some exhaust machines used in lamp manufacture, when the finished lamp must have a filling of argon in the outer envelope, it may not be practical to first exhaust the jacket in order to flash the barium and thereafter backfill with argon. In such case, the alternative of an oxidizable link enclosed in a separate smaller envelope may be used, which in turn is enclosed within the outer envelope of the lamp. As illustrated in FIG. 3, the ceramic wafer 22 supporting the contact strips 25, 26 is sealed in a small glass envelope or bottle 31 along with the getter-ring 27. The leads 23, 24 project through the wall of the bottle. The bottle is evacuated, flashed and tested, and then welded into the mount frame in lieu of the wafer of FIG. 2. The lamp is then placed on the exhaust machine and finished in the conventional manner, that is going directly to an argon fill. After the lamp has been thus completed, the internal glass bottle 31 is opened by any suitable means. For instance, a laser beam may be focused on the glass wall of the bottle to puncture a hole through it. Alternatively, radio frequency radiation may be applied to heat and melt a low temperature metal seal such as an indium plug 32 sealing the neck of the bottle 31. The gas pressure in the outer envelope will assist in opening the inner bottle by driving the indium ball in. The barium film fuse is then ready to operate and extinguish the arc tube should the outer envelope be punctured and air admitted into the jacket.

While the invention has been illustrated and described in detail by reference to a large mercury vapor lamp (400 watts) generally used outdoors, it is equally applicable to metal halide lamps. Also the fuse link of the invention is readily varied in current rating and adapted to various sizes of lamps including the miniature metal halide lamps disclosed in U.S. Pat. No. 4,161,672—Cap et al.

What we claim as new and desire to secure by Letters Patent of the United States is:

1. A jacketed electric lamp comprising:

a vitreous outer envelope having inleads sealed thereinto;

an arc tube within said outer envelope, said arc tube being made of material which transmits ultraviolet radiation;

said arc tube having electrodes sealed into its ends and containing an ionizable medium which produces radiation including ultraviolet which is normally intercepted at the outer envelope;

and means connecting the electrodes of the arc tube to the inleads of the outer envelope, said means including an oxidizable fuse conductor formed by a thin film of an alkaline earth metal on a non-conductive substrate, said film operating as a low resistance conductive bridge in said connecting means, and a vacuum or an inert gas filling in said outer envelope whereby said fuse conductor will oxidize and open-circuit the arc tube only upon fracture of said outer envelope and entry of air into it.

2. A lamp as in claim 1 wherein said thin metal film is barium.

3. A lamp as in claim 1 wherein the thin metal film is formed on said non-conductive substrate in a manner to overlap contact strips affixed thereto and connected into the arc tube circuit.

4. A lamp as in claim 3 wherein the thin film results from flashing the metal in a vacuum in a manner to deposit on said substrate and bridge over said contact strips.

5. A lamp as in claim 1 wherein the substrate bearing the thin film is enclosed in a separate smaller envelope which is enclosed within the outer envelope of the lamp and then opened to an inert gas atmosphere contained in said outer envelope.

* * * * *